US011304481B1

(12) United States Patent
Renner, II

(10) Patent No.: US 11,304,481 B1
(45) Date of Patent: Apr. 19, 2022

(54) BUCKLE

(71) Applicant: Nomad Innovations, LLC, Springville, UT (US)

(72) Inventor: Tennyson David Renner, II, Springville, UT (US)

(73) Assignee: Nomad Innovations, LLC, Springville, UT (US)

( * ) Notice: Subject to any disclaimer, the term of this patent is extended or adjusted under 35 U.S.C. 154(b) by 0 days.

(21) Appl. No.: 16/800,082

(22) Filed: Feb. 25, 2020

Related U.S. Application Data

(60) Provisional application No. 62/809,834, filed on Feb. 25, 2019.

(51) Int. Cl.
*A44B 11/22* (2006.01)

(52) U.S. Cl.
CPC ..... *A44B 11/22* (2013.01)

(58) Field of Classification Search
CPC ..... A44B 11/2523; A44B 11/2561; A44B 11/2588; A44B 11/2526; A44B 11/258; A44B 11/2584; Y10T 24/32; Y10T 24/4782; Y10T 24/1498; B65D 2563/103
See application file for complete search history.

(56) References Cited

U.S. PATENT DOCUMENTS 1,290,914 A 1/1919 Comstock, Sr.
1,675,040 A 6/1928 Mix
1,697,833 A 1/1929 Lane
3,027,617 A 4/1962 Gray
3,293,714 A 12/1966 Shafer
3,589,341 A * 6/1971 Krebs ..... A01K 27/005 119/865

(Continued)

FOREIGN PATENT DOCUMENTS

KR 20100009777 U 10/2010
KR 20130072649 A 7/2013

(Continued)

OTHER PUBLICATIONS

U.S. Appl. No. 10/212,993, filed Feb. 26, 2019, Fiedler et al.

(Continued)

*Primary Examiner* — Robert Sandy
(74) *Attorney, Agent, or Firm* — Goff IP Law PLLC; Jared Goff

(57) ABSTRACT

First and second buckle members can be secured in a buckled configuration and can be separated in an unbuckled configuration by moving the buckle member(s) along an extraction direction. In the buckled configuration a row of one or more teeth of the first buckle member and a row of one or more teeth of the second buckle member can cooperate in responding to a tension force pulling the first buckle member away from the second buckle member along the extraction direction by opposing movement of the first buckle member away from the second buckle member along the extraction direction, and using the tension force to guide the first buckle member and the second buckle member laterally toward a centered position. A buckle can include this centering feature, a spring ejection mechanism, an obstruction to inhibit engagement with less than a predetermined number of teeth rows, and/or other features.

9 Claims, 9 Drawing Sheets

(56) References Cited

U.S. PATENT DOCUMENTS

| | | | | |
|---|---|---|---|---|
| 3,735,449 | A * | 5/1973 | Rosales | B65D 63/1063 24/16 PB |
| 3,747,164 | A * | 7/1973 | Fortsch | B65D 63/16 24/16 PB |
| 4,369,553 | A | 1/1983 | Yuda | |
| 4,715,839 | A | 12/1987 | Ford et al. | |
| 4,872,242 | A * | 10/1989 | Allan | B65D 63/1018 24/16 PB |
| 4,928,364 | A | 5/1990 | Ikeda | |
| 5,077,839 | A | 1/1992 | Keller | |
| 5,243,741 | A | 9/1993 | Fudaki et al. | |
| D348,420 | S | 7/1994 | Edsall | |
| D349,664 | S | 8/1994 | Ueno | |
| 5,465,472 | A | 11/1995 | Matoba | |
| D387,307 | S | 12/1997 | Matoba | |
| 5,887,318 | A | 3/1999 | Nicoletti | |
| 6,154,936 | A | 12/2000 | Howell et al. | |
| 6,292,985 | B1 | 9/2001 | Grunberger | |
| 6,308,381 | B1 | 10/2001 | Wilson | |
| 6,487,761 | B2 | 12/2002 | Tassel | |
| 6,598,271 | B2 | 7/2003 | Nire | |
| 6,606,767 | B2 | 8/2003 | Wong | |
| 6,898,826 | B2 * | 5/2005 | Draper | A43C 11/1486 24/170 |
| 7,117,569 | B2 * | 10/2006 | Bledsoe | A41F 1/008 24/593.11 |
| 7,254,872 | B2 | 8/2007 | Ross | |
| 8,505,174 | B2 | 8/2013 | Fildan et al. | |
| D711,773 | S | 8/2014 | Kolasa et al. | |
| 8,800,121 | B2 | 8/2014 | Berns et al. | |
| 9,572,410 | B2 | 2/2017 | Fiedler | |
| 9,622,532 | B2 | 4/2017 | Tryner et al. | |
| 9,907,345 | B2 | 3/2018 | O'Neill | |
| 9,907,367 | B2 | 3/2018 | Paik et al. | |
| D814,969 | S | 4/2018 | Renforth et al. | |
| 9,930,936 | B2 | 4/2018 | Liu | |
| 9,974,348 | B2 | 5/2018 | Wilkins-Gaudio | |
| D826,083 | S | 8/2018 | Miller | |
| 10,407,226 | B2 * | 9/2019 | Harsley | F16L 3/2336 |
| D879,659 | S | 3/2020 | Deng | |
| 2002/0092140 | A1 | 7/2002 | Tassel | |
| 2003/0041423 | A1 | 3/2003 | Lai | |
| 2003/0098027 | A1 | 5/2003 | Mori | |
| 2004/0259468 | A1 | 12/2004 | Bergamelli | |
| 2005/0066481 | A1 | 3/2005 | Chen | |
| 2006/0150304 | A1 | 7/2006 | Bentz | |
| 2008/0028500 | A1 | 2/2008 | Bentz | |
| 2008/0155793 | A1 | 7/2008 | Chen | |
| 2009/0293243 | A1 | 12/2009 | Yoshiguchi | |
| 2010/0263171 | A1 | 10/2010 | Paik | |
| 2010/0325844 | A1 | 12/2010 | Fiedler | |
| 2012/0060330 | A1 | 3/2012 | Fildan et al. | |
| 2012/0080917 | A1 | 4/2012 | Miller et al. | |
| 2013/0097828 | A1 | 4/2013 | Hashimoto | |
| 2014/0277103 | A1 | 9/2014 | Esposito | |
| 2014/0317890 | A1 | 10/2014 | Koons et al. | |
| 2015/0033457 | A1 | 2/2015 | Tryner et al. | |
| 2015/0135486 | A1 | 5/2015 | Fiedler et al. | |
| 2015/0237970 | A1 | 8/2015 | Baile | |
| 2016/0309854 | A1 | 10/2016 | Maloney | |
| 2016/0374436 | A1 | 12/2016 | Park | |
| 2017/0127768 | A1 | 5/2017 | Paik et al. | |
| 2017/0360159 | A1 | 12/2017 | Anderson | |
| 2018/0092439 | A1 | 4/2018 | Fildan et al. | |
| 2018/0140031 | A1 | 5/2018 | Fildan et al. | |
| 2018/0146730 | A1 | 5/2018 | Fildan et al. | |
| 2018/0368532 | A1 | 12/2018 | Hurt | |
| 2019/0029329 | A1 | 1/2019 | Zhang | |
| 2019/0072360 | A1 | 3/2019 | Son | |
| 2019/0125037 | A1 | 5/2019 | Kelly | |
| 2019/0388767 | A1 | 12/2019 | Tryner et al. | |
| 2020/0138150 | A1 | 5/2020 | Dollman | |

FOREIGN PATENT DOCUMENTS

| | | | |
|---|---|---|---|
| KR | 101981306 | B1 | 5/2019 |
| WO | WO2019011823 | A1 | 1/2019 |

OTHER PUBLICATIONS

U.S. Appl. No. 10/264,855, filed Apr. 23, 2019, Jeanty.
U.S. Appl. No. 10/272,016, filed Apr. 30, 2019, Allyn et al.
U.S. Appl. No. 10/617,179, filed Apr. 14, 2020, Fiedler et al.
Yaak M-Series Magnetic Belts, Printout, accessed at https://yaak.design/products/m-series-belts.html/, Accessed on Oct. 15, 2020, 6 Pages.
Yaak M-Series Magnetic Belts, Screenshot, accessed at https://yaak.design/pro.
"Fastener 25 alu motorbike—Fidlock", Accessed from https://www.youtube.com/watch?v=bgngMyudzxc, Accessed on Feb. 24, 2020, 2 Pages.
"Ruroc Atlas—Fidlock Chin Strap System!", accessed at https://www.fidlock.com/en/fasteners/hook/25-alu-motorbike.html, Accessed on Feb. 24, 2020, 1 Page.

* cited by examiner

BUCKLE

RELATED APPLICATIONS

The present application is a non-provisional application claiming priority to U.S. Provisional Patent Application No. 62/809,834, filed Feb. 25, 2019 and entitled AUTO-CENTERING AND AUTO-EJECTING BUCKLE FOR FASTENING OF OBJECTS BY WAY OF TWO LENGTHS OF ELASTIC MATERIAL, which is incorporated herein by reference. If any disclosures are incorporated herein by reference and such incorporated disclosures conflict in part or whole with the present disclosure, then to the extent of conflict, and/or broader disclosure, and/or broader definition of terms, the present disclosure controls. If such incorporated disclosures conflict in part or whole with one another, then to the extent of conflict, the later-dated disclosure controls.

BACKGROUND

Various buckles have been used to temporarily fasten objects to each other. For example, such buckles have been used in securing cargo for transportation, in affixing items of utility close to a person in ordinary use and in specialized uses. Such specialized uses may include tactical operations such as those common in law enforcement and military activities. As one example, buckles have been used to secure strap ends and thereby removably secure helmets, such as motorcycle helmets, to people's heads.

SUMMARY

Whatever the advantages of previous buckles, they have neither recognized the features described and claimed herein, nor the advantages produced by such features alone or in combination.

According to a first aspect, a buckle can include a first buckle member, which may include a body and a row of one or more teeth extending from the body. The buckle can also include a second buckle member, which may include a body and a row of one or more teeth extending from the body, with the first buckle member and the second buckle member being configured to be secured to each other in a buckled configuration and to be separated from each other in an unbuckled configuration by moving the first buckle member relative to the second buckle member along an extraction direction. The first buckle member and the second buckle member can be configured so that in the buckled configuration the row of one or more teeth of the first buckle member and the row of one or more teeth of the second buckle member cooperate in responding to a tension force pulling the first buckle member away from the second buckle member along the extraction direction. This response may include opposing movement of the first buckle member away from the second buckle member along the extraction direction and using the tension force to guide the first buckle member and the second buckle member laterally toward a centered position relative to each other. The guiding toward the centered position may include guiding a central portion of the row of one or more teeth of the first buckle member along a first lateral direction to align with a central portion of the row of one or more teeth of the second buckle member, and guiding the first buckle member along a second lateral direction to bias the row of one or more teeth of the first buckle member toward a base of the row of one or more teeth of the second buckle member.

According to a second aspect, a buckle can include a first buckle member, which may include a first set of multiple rows of teeth. The buckle can also include a second buckle member, which may include a second set of multiple rows of teeth that are configured to interlock with the first set of multiple rows of teeth to removably secure the second buckle member to the first buckle member in a buckled configuration. The second buckle member may also include an obstruction that is configured to inhibit engagement between the first set of multiple rows of teeth and the second set of multiple rows of teeth until a predetermined number of rows of the first set of multiple rows of teeth are aligned to interlock with a predetermined number of rows of the second set of multiple rows of teeth, where the predetermined number of rows of the first set of multiple rows of teeth is at least two and the predetermined number of rows of the second set of multiple rows of teeth is at least two.

According to a third aspect, a buckle can include a first buckle member. The buckle can also include a second buckle member, with the first buckle member and the second buckle member being configured to be releasably secured to each other in a buckled configuration. The buckle can also include a buckle ejection mechanism, which may include a catch that is part of one of the first buckle member and the second buckle member, and a spring that is part of the other of the first buckle member and the second buckle member. The first buckle member and the second buckle member can be configured so that the catch engages and energizes the spring as the first buckle member is moved relative to the second buckle member into the buckled configuration. Also, the first buckle member and the second buckle member can be configured so that the spring uses the catch to bias the first buckle member and the second buckle member away from each other and out of the buckled configuration when the first buckle member is not secured to the second buckle member.

According to a fourth aspect, a method of securing a buckle can include securing a first buckle member and a second buckle member together in a buckled configuration. The securing may include a row of one or more teeth of the first buckle member and a row of one or more teeth of the second buckle member cooperating in responding to a tension force pulling the first buckle member away from the second buckle member along an extraction direction by opposing movement of the first buckle member away from the second buckle member along the extraction direction, and by using the tension force to guide the first buckle member and the second buckle member laterally toward a centered position relative to each other. The guiding toward the centered position may include the following: guiding a central portion of the row of one or more teeth of the first buckle member along a first lateral direction to align with a central portion of the row of one or more teeth of the second buckle member; and guiding the first buckle member along a second lateral direction to bias the row of one or more teeth of the first buckle member toward a base of the row of one or more teeth of the second buckle member. The securing can also include separating the first buckle member and the second buckle member from each other in an unbuckled configuration. The separating can include disengaging the row of one or more teeth of the first buckle member from the row of one or more teeth of the second buckle member and moving the first buckle member relative to the second buckle member along the extraction direction.

This Summary is provided to introduce a selection of concepts in a simplified form. The concepts are further described below in the Detailed Description. This Summary is not intended to identify key features or essential features of the claimed subject matter, nor is it intended to be used to limit the scope of the claimed subject matter. Similarly, the invention is not limited to implementations that address the particular techniques, tools, environments, disadvantages, or advantages discussed in the Background, the Detailed Description, or the attached drawings.

BRIEF DESCRIPTION OF THE DRAWINGS

The description and drawings may refer to the same or similar features in different drawings with the same reference numbers.

DETAILED DESCRIPTION

Figure 1:
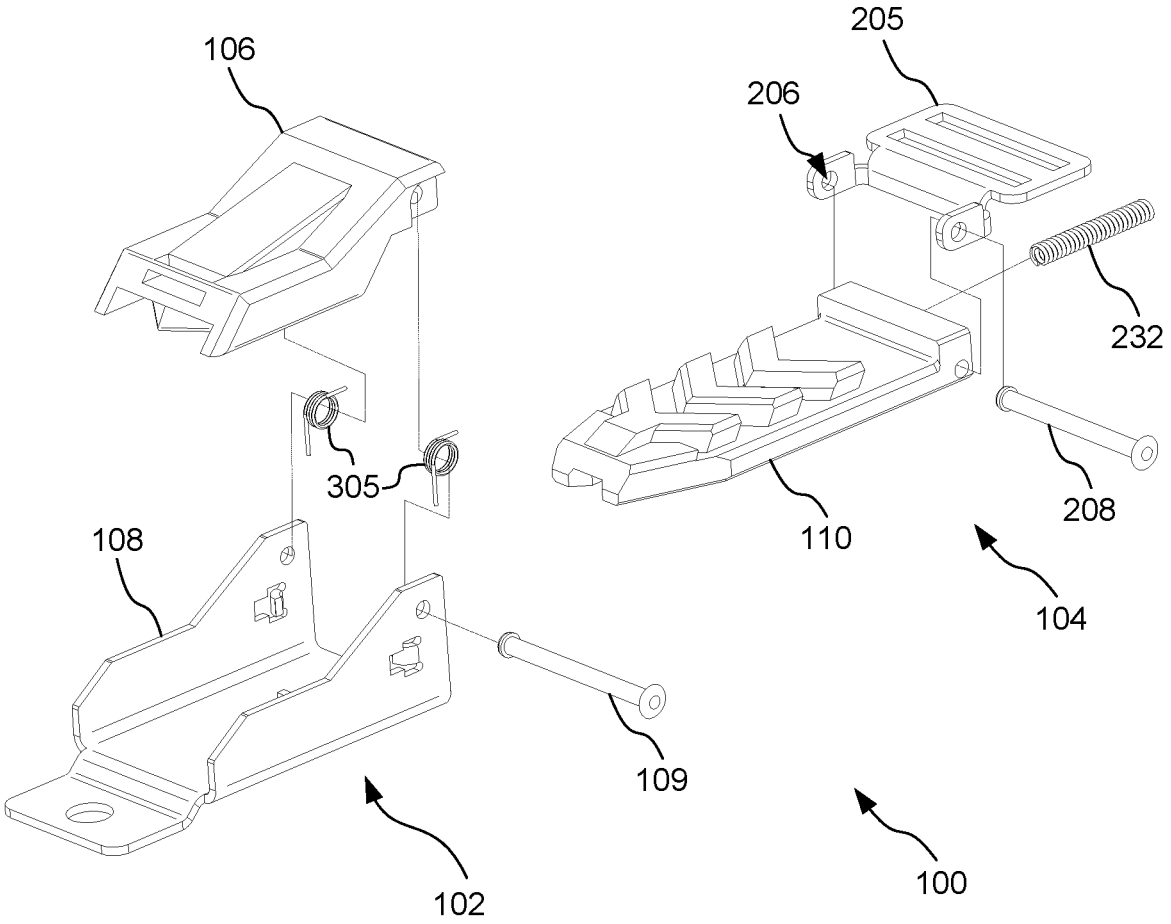
FIG. 1 is an exploded front, side, top perspective view of a buckle.
Figure 2:
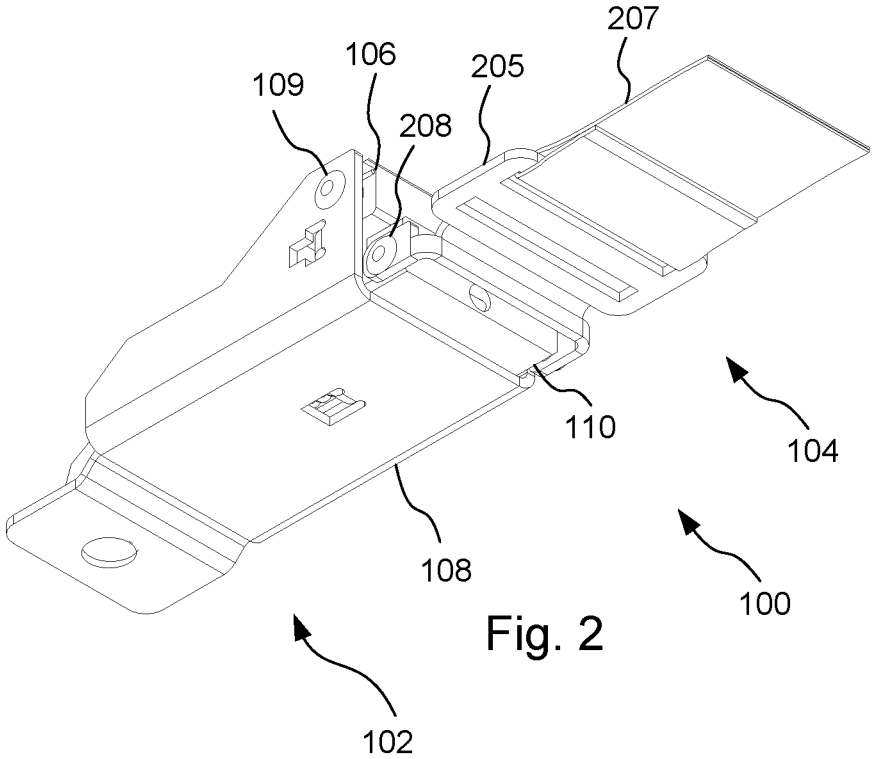
FIG. 2 is a back, side, bottom perspective view of the buckle of FIG. 1 along with a strap secured to the buckle, with the buckle in a buckled configuration.
Figure 3:
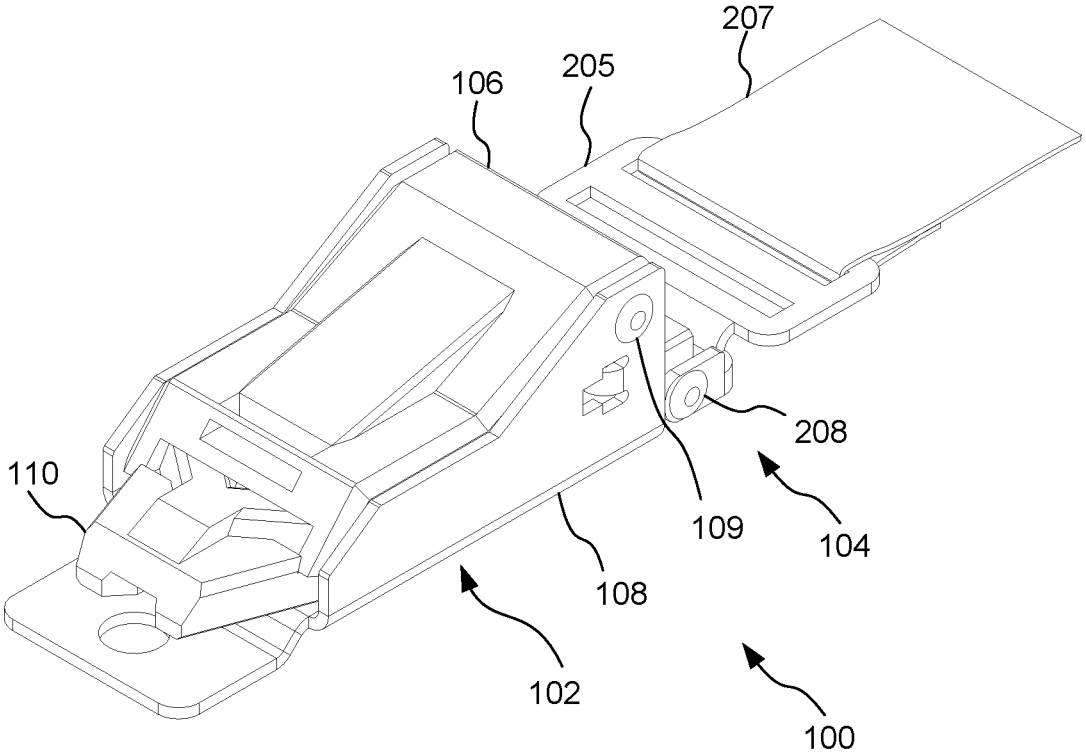
FIG. 3 is a front, side, top perspective view of the buckle of FIG. 2.
Figure 4:
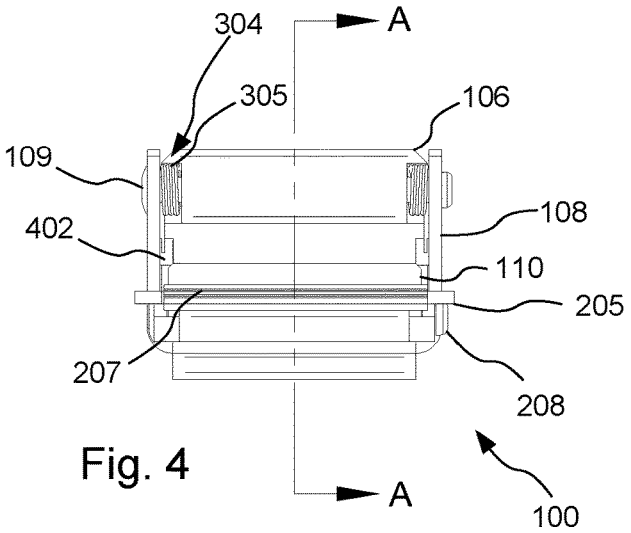
FIG. 4 is a back view of the buckle of FIG. 2.

One embodiment of a buckle 100 is illustrated in FIGS. 1-19. The buckle 100 can include a female buckle member 102 and a male buckle member 104. The female buckle member 102 can include a detent 106 (which may be a pawl or clasp) that can be seated in a base 108, with the detent 106 being configured to rotate about a pivot 109 (such as a pin, arbor, shaft, or rivet). A rack 110 (which may be any of various shapes and designs that can include at least one tooth to be engaged by the detent 106, such as a toothed plate, bar, strap, or ratchet), which is part of the male buckle member 104, can be positioned between the detent 106 and the base 108 in a buckled configuration illustrated in FIGS. 1-6, with the detent 106 engaging the rack 110. As is discussed more below, the detent 106 can be moved away from the rack 110 to allow the male buckle member 104 to be moved away relative to the female buckle member 102 in an extraction direction 120, which is opposite to an insertion direction 122 in which the male buckle member 104 can be moved relative to the female buckle member 102 to join the male buckle member 104 and the female buckle member 102 in the buckled configuration.

I. BUCKLE STRUCTURE

The structure of the buckle 100 will now be described, first discussing details of the male buckle member 104 and then discussing details of the female buckle member 102.

A. Male Buckle Member

Figure 8:
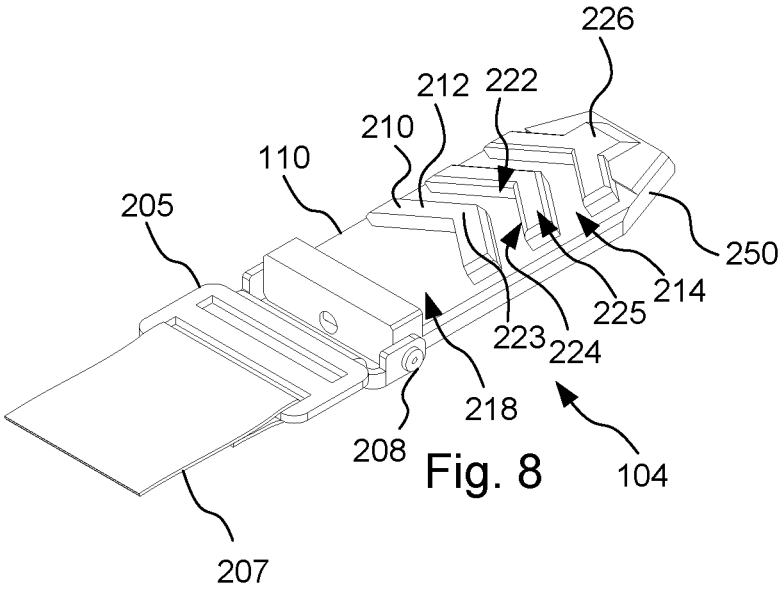
FIG. 8 is a back, side, top perspective view of a male buckle member (which may be called a first buckle member or a second buckle member herein) of the buckle of FIG. 2.

FIG. 8 illustrates the male buckle member 104, which will now be described in more detail with reference to FIGS. 1-13. FIG. 1 includes route lines to illustrate the way the parts of the male buckle member 104 are interconnected. Referring still to FIGS. 1-13, the male buckle member 104 can include the rack 110, which can include a body 112. The rack 110 can define a rivet bore 204, which can extend through the body 112 of the rack 110 from one side to an opposite side in a lateral direction, which can be perpendicular to the extraction direction 120 and the insertion direction 122, near the back of the rack 110.

The male buckle member 104 can include a strap retainer 205, which can be secured to the rack 110. For example, the rivet bore 204 of the rack 110 can be co-axially interposed between clearance holes 206 of the strap retainer 205. A fastener such as a rivet 208 can extend through the clearance holes 206 of the strap retainer 205 and through the rivet bore 204 of the rack 110 to secure the strap retainer 205 to the rack 110, but to allow rotation of the strap retainer 205 relative to the rack 110 around the rivet 208, which can act as a pivot between the strap retainer 205 and the rack 110. Additionally, a body such as a strap 207 can be secured to the strap retainer 205, such as in a conventional way straps are secured to retainers (such as by being looped and tacked), so that the strap 207 can be secured to the rack 110 via the strap retainer 205. For example, the strap 207 may be a flat material such as a flat elastic material such as webbing. Alternatively, the rack 110 may be secured to some other body besides a strap, such as where the rack 110 may be secured to a rigid portion of a helmet, while the female buckle member 102 may be secured to a strap.

The rack 110 can include multiple rows 210 of teeth 212, such as bossed teeth. In the illustrated example of the figures, the rack 110 includes three rows 210 of teeth, but it can include different numbers of rows. In the illustrated example, each row 210 can include a single tooth 212, which can protrude from the body 112 of the rack 110. The rows 210 can be spaced along the extraction direction 120 and the insertion direction 122 to define gaps 214 between adjacent rows 210 of the teeth 212.

Figure 20:
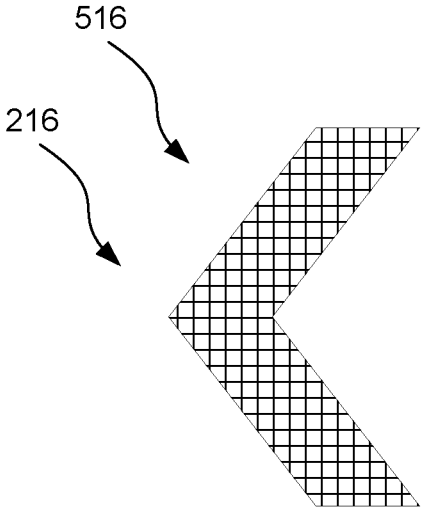
FIG. 20 is a schematic illustration of a tooth profile of the base of a tooth from which a tooth may project for a tooth of the rack or detent of the buckle of FIG. 2, which includes a single tooth in a tooth row.

The illustrated rows 210 of the teeth 212 are provided as an example of teeth on the male buckle member 104 for cooperating with the female buckle member 102 to retain the buckle 100 in its buckled configuration. One row 210 of a tooth 212 can be visualized as cross-sectional tooth row profile 216 (see FIG. 20), existing on a rack surface 218 (which can be a plane, and can form a base for the teeth 212) of the rack 110, extruded back at an angle that rises from the rack surface 218, angling back toward the back end of the rack 110 (in the extraction direction 120 for the male buckle member 104 relative to the female buckle member 102). In other words, each tooth row 210 can project the profile 216 at an angle backward and away from the rack surface 218, which can create a slight overhang from its origin at the rack surface 218 on the back side and a slope on the front side, respectively. Edges of the teeth 212 that are distal from the rack surface 218 may be beveled and/or rounded to assist in allowing mating teeth of the detent 106 to mesh with the teeth 212 of the rack 110. In figures, three rows 210 of teeth 212 are shown, but the pitched pattern can be repeated to produce however many teeth may best suit a given use case. Additionally, bossed teeth are shown to be linearly projecting from the rack surface 218, but the teeth 212 may project from the rack surface 218 in non-linear paths, such as being revolved along circular paths, such as circular paths centered around the rivet 208 or the pivot 109 in the buckled configuration.

In the embodiment of the rack 110, the profile 216 of each row 210 can generally be a chevron shape, which angles back in the extraction direction 12 for the male buckle member 104 as each row 210 extends out from a central area of the rack surface 218. With such a chevron shape, each tooth row 210 can include a first engaging surface portion 222 that faces backward on the overhanging back of the tooth row 210 on a first side of a central portion 223 the tooth row 210. Each tooth row 210 can also include a second engaging surface portion 224 that faces backward on the overhanging back of the tooth row 210 on a second side of the central portion 223 of the tooth row 210 that is opposite the first side of the tooth row 210.

The first engaging surface portion 222 and the second engaging surface portion 224 can each be angled at a non-perpendicular and non-parallel angle relative to the extraction direction 120 and the insertion direction 122 along a first plane (such as a plane that is parallel with the rack surface 218) that extends parallel to the extraction direction 120 and the insertion direction 122. The first engaging surface portion 222 and the second engaging surface portion 224 can also be angled at non-perpendicular and non-parallel angles relative to the extraction direction 120 and the insertion direction 122 along a second plane extending parallel to the extraction direction 120 and the insertion direction 122 and perpendicular to the first plane (such as a pair of planes that each extend parallel to extraction direction 120 and the insertion direction 122 and are perpendicular to the rack surface 218, with one of the pair of planes intersecting the first engaging surface portion 222 and the other plane intersecting the second engaging surface portion 224). Each row 210 can also include a distal surface portion 225, which can generally face in the same direction as the rack surface 218 but can be located on the row 210 distal from the rack surface 218.

The rack 110 can also include an engagement pilot 226 or pilot boss, which can extend forward from a central portion of a front-most tooth row 210. A front surface of the engagement pilot can slope forward and down, so that the engagement pilot can act as an obstruction to inhibit movement of portions of the detent 106 from extending into an area immediately in front of the front-most tooth row 210, and can guide portions of the detent 106 upward and over the front-most tooth row 210 as the male buckle member is inserted into the female buckle member 102, as is discussed more below.

Referring still to FIGS. 1-13, and particularly to FIGS. 5-7, 9, 11, and 13, additional features of the male buckle member 104 will be discussed. A spring bore 230 extends into the body 112 of the rack 110 from the back of the body 112, perpendicularly intersecting the rivet bore 204, and extending only partially into the body 112 of the rack 110. A compression spring 232 can be diametrically retained internally to the rack 110 by material surrounding the spring bore 230, and can be axially retained by a front termination of the spring bore 230 (which is enlarged in FIG. 7) on a front end of the compression spring 232 and by the rivet 208 on a back end of the compression spring 232. An access slot 240 on the underside of the body 112 of the rack 110 can be open on its front and bottom sides. The access slot 240 can extend partially inward into the body 112 of the rack 110, and can taper symmetrically outwards at its opening at the front of the rack 110, with the taper being designated as a catch taper 242 herein.

An additional taper, or an insertion taper 250, can be formed on each of the front portions of the longitudinally parallel sides of the rack 110. While the spring bore 230 and the access slot 240 can start on opposite ends of the rack 110, the spring bore 230 and access slot 240 can extend longitudinally far enough to form an area between the front and back ends of the rack 110 in which there is a slot and bore overlap 252, or in other words an area where the access slot 240 and the spring bore 230 void profiles can overlap each other co-axially.

B. Female Buckle Member

Referring now to FIGS. 1-6, 9, and 14-19, the female buckle member 102 will be discussed in more detail. The female buckle member 102 can be complimentary to the male buckle member 104. FIG. 1 includes route lines to indicate assembly relations between parts of the female buckle member 102. In this embodiment, the detent 106 of the female buckle member 102 can define spring recesses 304 in which two torsion springs 305 can be interposed between the detent 106 and the base 108, co-axially with the pivot 109 (the rivet in an example). The torsion springs 305 could alternatively be replaced with a single torsion spring, or a double torsion spring, so long as the torsion member can sufficiently bias the detent 106 to pivot downwards towards the rack 110 in the buckled configuration illustrated in FIGS. 2-6.

Figure 14:
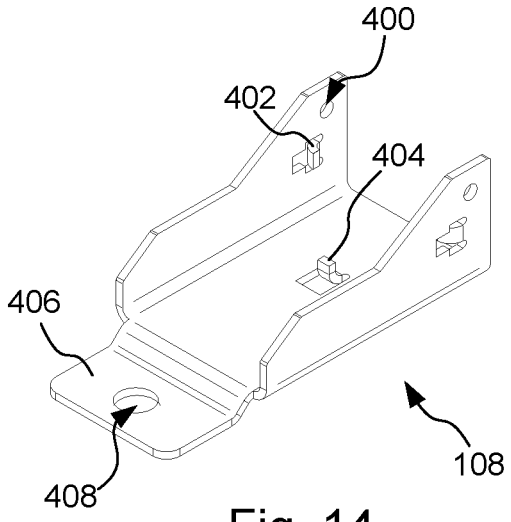
FIG. 14 is a front, side, top perspective view of a base of the female buckle member of the buckle of FIG. 2.
Figure 15:
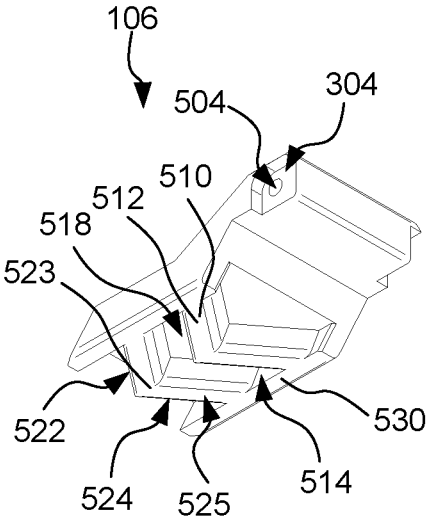
FIG. 15 is a back, side, bottom perspective view of a detent of the female buckle member of the buckle of FIG. 2.
Figure 16:
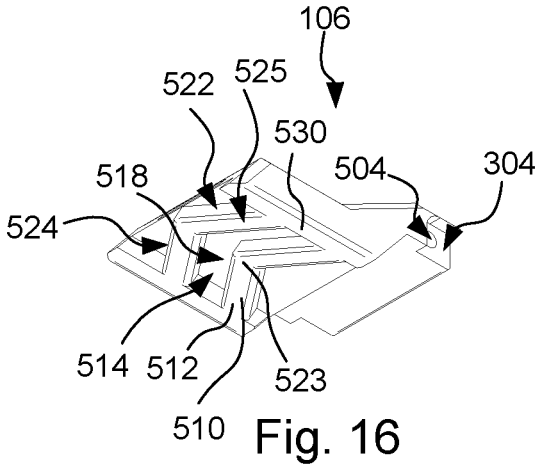
FIG. 16 is a front, side, bottom perspective view of the detent of FIG. 15.
Figure 17:
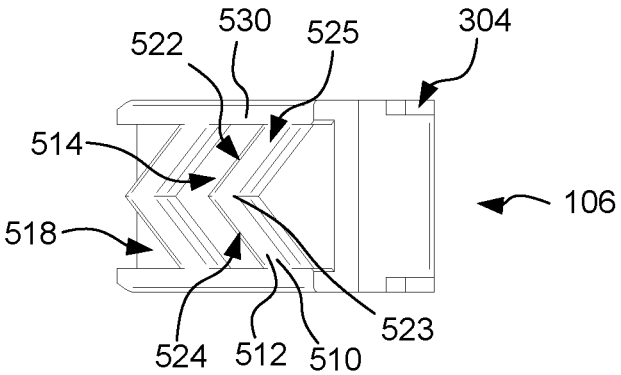
FIG. 17 is a bottom view of the detent of FIG. 15.
Figure 18:
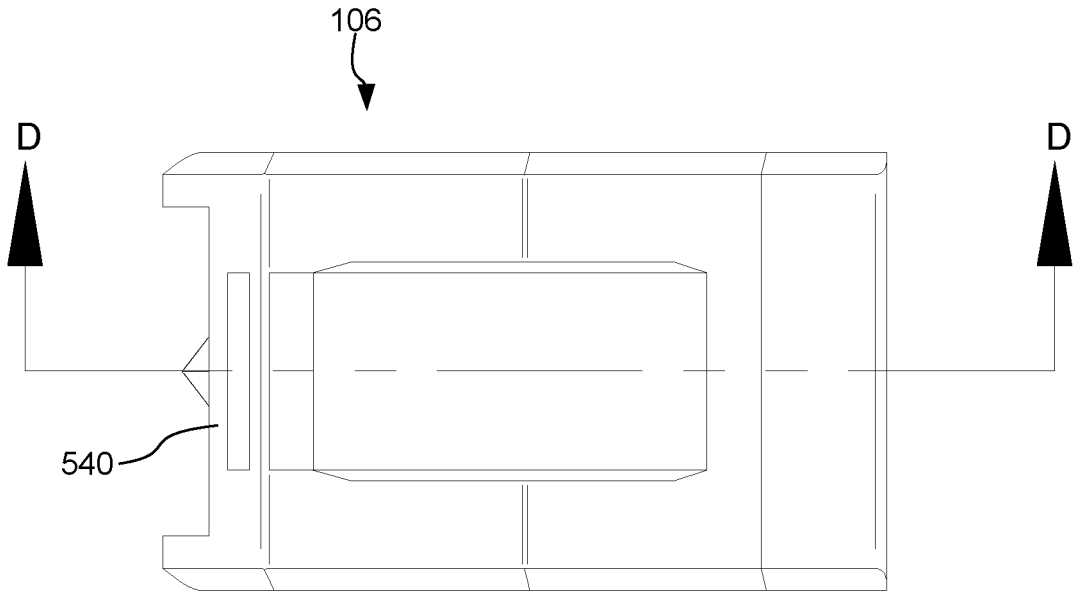
FIG. 18 is a top view of the detent of FIG. 15.
Figure 19:
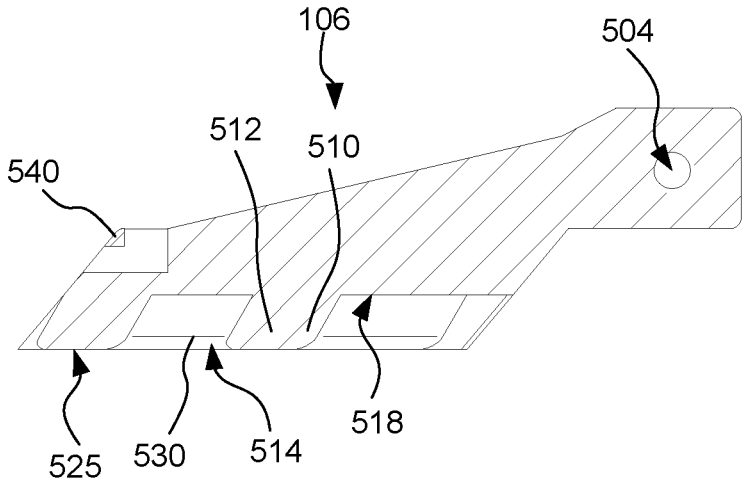
FIG. 19 is a side sectional view of the detent of FIG. 15 taken along line D-D of FIG. 19.

Referring to FIG. 14, the base 108 can define pivot holes 400 near the rear and top of the base 108, with the pivot holes extending laterally through parallel side walls of the base 108. The pivot holes 400 can receive the pivot 109. Torsional blocks 402 (such as tabs, extrusions, bosses, or torsional detents) can extend inward from both parallel side walls of the base 108. The torsional blocks 402 may be an of various shapes and configurations, but the torsional blocks 402 can be oriented and placed to circumferentially constrain torsion springs about the pivot 109 when assembled in conjunction the detent 106.

A catch 404 (such as a tab, boss, protrusion, finger or linear detent) can protrude up from the floor of the base 108. The catch 404 can be co-linear with the spring bore 230 and the access slot 240 as the male buckle member 104 slides into the female buckle member 102. In this embodiment, the torsional blocks 402 and the catch 404 are shown to be ductilely derived from the existing material of the base 108. This can obviate the need for extra parts or post-processing to form the torsional blocks 402 and the catch 404. However, other techniques may be used to form these features, such as forming injection molded bosses or machined islands to create the torsional blocks 402 and the catch 404.

A tacking tab 406 with a centered through-hole or tacking hole 408 can extend forward at the front of the base 108. A fastener (not shown, such as a rivet, bolt, or screw) can extend through the tacking hole 408 and into a body (not shown) to secure the female buckle member 102 to that body. Present at the rear of female buckle member 102, between rear of the detent 106 and the adjacent side and floor surfaces of the base 108, is an entry 410 (a void, aperture, or breech) into which the male buckle member 104 can be inserted.

Referring to FIGS. 5-6 and 15-17, a rear of the detent 106 can define a laterally extending pivot hole 504, which can receive the pivot 109, around which the detent 106 can rotate. The spring recesses 304 can be located around each end of the pivot hole 504, with the torsion springs 305 extending around the pivot 109 in the spring recesses 304, and with each torsion spring 305 having one leg engaging the detent 106 and another leg engaging the torsion blocks 402 of the base 108.

The bottom of the detent 106 can include multiple rows 510 of teeth 512, such as bossed teeth. In the illustrated example, each row 510 can include a single tooth 512, which can protrude from a body of the detent 106. The rows 510 can be spaced along the extraction direction 120 and the insertion direction 122 in the buckled configuration to define gaps 514 between adjacent rows 510 of teeth 512.

The illustrated rows 510 of teeth 512 are provided as an example of teeth on the female buckle member 102 for cooperating with the male buckle member 104 to retain the buckle 100 in its buckled configuration. Similarly to the teeth 212 of the rack 110, a row 510 of a tooth 512 can be visualized as cross-sectional tooth row profile 216 (see FIG. 20), existing on a detent surface 518 (which can be a plane and can form a base for the teeth 512) of the detent 106, protruding forward at an angle that descends from the detent surface 518 and angles forward toward the front end of the detent 106 (angling down and in the insertion direction 122). Like the teeth 212 of the rack 110, edges of the teeth 512 that are distal from the detent surface 518 may be beveled and/or rounded to assist in allowing mating teeth of the rack 110 to mesh with the teeth 512.

In other words, each tooth row 510 can project the profile 516 at an angle forward and away from the detent surface 518, which can create a slight upside-down overhang from its origin at the rack surface 218 on the front side and an upside-down slope on the back side, respectively. In the illustrations, two rows 510 of teeth 512 are shown, but the pitched pattern can be repeated to produce however many teeth may best suit a given use case. Additionally, bossed teeth are shown to be linearly projecting from the detent surface 518, but the teeth 512 may project from the detent surface 518 in non-linear paths, such as being revolved along circular paths, such as circular paths centered around the pivot 109 or around the rivet 208 in the buckled configuration.

In the embodiment of the detent 106, the profile 516 of each row 510 can generally be a chevron shape, which may match the chevron shaped profile 216 of the rows 210 of teeth 212 of the rack 110. More specifically, bottom side of the detent 106 can define the same profile 216 as shown in the previous figure, except as a negative space or extruded cut that can be somewhat enlarged as compared to the teeth 212 of the rack 110, so that the teeth 212 of the rack 110 can fit into the negative space. Following is a description of the positive space, or the rows 510 of teeth 512 of the detent 106. The profile 516 of each row 510 of teeth 512 of the detent 106 can angle forward in the insertion direction 122 as each row 510 extends out from a central area of the detent surface 518. With such a chevron shape, each tooth row 510 can include a first engaging surface portion 522 that faces forward on the overhanging front of the tooth row 510 on a first side of a central portion 523 the tooth row 510. Each tooth row 510 can also include a second engaging surface portion 524 that faces forward on the front of the tooth row 510 on a second side of the tooth row 510 that is opposite the first side of the tooth row 510. The first engaging surface portion 522 and the second engaging surface portion 524 can each be angled at a non-perpendicular and non-parallel angle relative to the extraction direction 120 and the insertion direction 122 in the buckled configuration along a first plane (such as a plane that is parallel with the detent surface 518) that extends parallel to the extraction direction 120 and the insertion direction 122. In the buckled configuration the first engaging surface portion 522 and the second engaging surface portion 524 can also be angled at non-perpendicular and non-parallel angles relative to the extraction direction 120 and the insertion direction 122 along a second plane extending parallel to the extraction direction 120 and the insertion direction 122 and perpendicular to the first plane (such as a pair of planes that each extend parallel to the extraction direction 120 and the insertion direction 122, and are perpendicular to the detent surface 518, with one of the pair of planes intersecting the first engaging surface portion 522 and the other plane intersecting the second engaging surface portion 524). Each row 510 can also include a distal surface portion 525, which can generally face in the same direction as the detent surface 518 but can be located on the row 510 distal from the detent surface 518.

Figure 5:
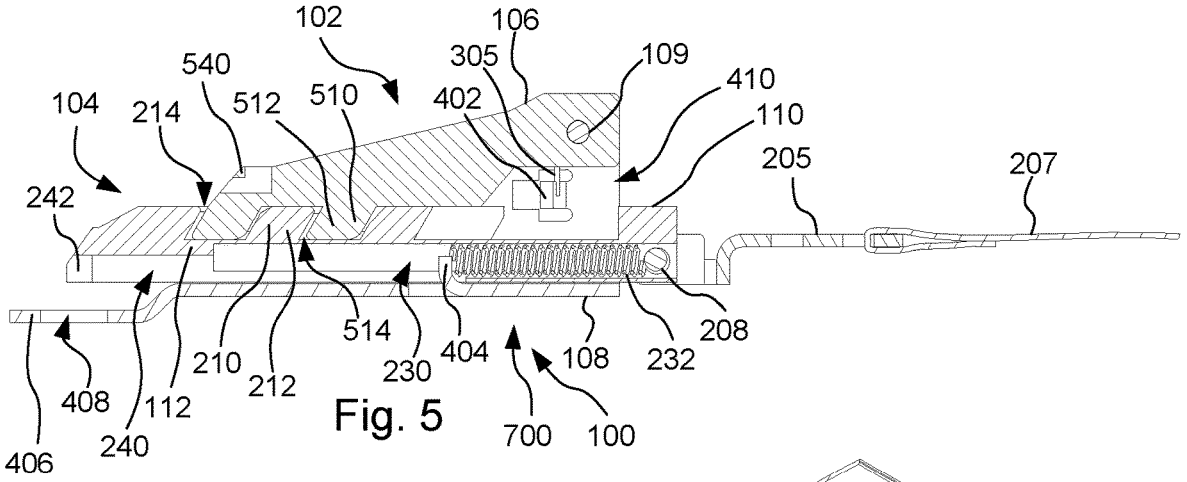
FIG. 5 is a side sectional view of the buckle of FIG. 2 taken along line A-A of FIG. 4.
Figure 6:
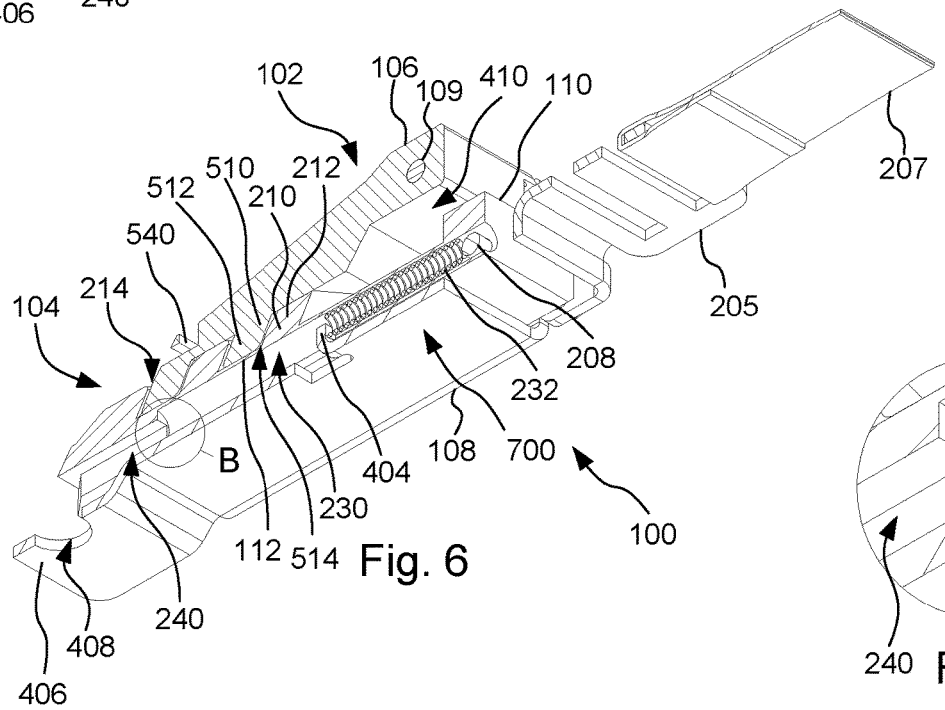
FIG. 6 is a back, side, bottom perspective sectional view of the buckle of FIG. 2 sectioned along line A-A of FIG. 4.
Figure 7:
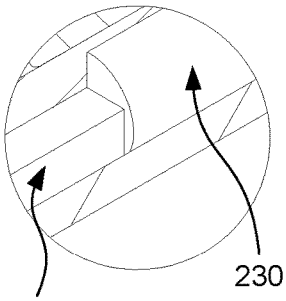
FIG. 7 is an enlarged view of an area encircled by line B in FIG. 6.

The detent 106 can also include side rails 530 extending down from opposite sides of the detent surface 518. The side rails 530 can join ends of the rows 510 of teeth 512 together, which can strengthen the teeth 512, and the side rails can also extend longitudinally beyond the rows 510 of teeth 512. In the buckled configuration, the rows 210 of teeth 212 of the rack 110 can be positioned longitudinally within the gaps 514 between adjacent rows 510 of teeth 512 of the detent 106, and possibly also within spaces in front of and behind the set of rows 510 of teeth 512 of the detent 106 (as shown in FIGS. 5-6). The rows 210 of teeth 212 of the rack 110 can also be positioned laterally within spaces between the side rails 530.

In the buckled configuration, the rows 210 of teeth 212 of the rack 110 can be interlocked with the rows 510 of teeth 512 of the detent 106. Accordingly, in the buckled configuration, the rows 510 of teeth 512 of the detent 106 can be positioned longitudinally within the gaps 214 between adjacent rows 210 of teeth 212 of the rack 110, and possibly also within spaces in front of and behind the set of rows 210 of teeth 212 of the rack 110 in different embodiments from the one illustrated in the figures. In the buckled configuration, the first engaging surface portions 222 of the teeth 212 of the rack 110 can abut and engage the first engaging surface portions 522 of the teeth 512 of the detent 106, and the second engaging surface portions 224 of the teeth 212 of the rack 110 can abut and engage the second engaging surface portions 524 of the teeth 512 of the detent 106. Also, the distal surface portions 225 of the teeth 212 of the rack 110 can abut and engage the detent surface 518 of the detent 106, and/or the distal surface portions 525 of the teeth 512 of the detent 106 can abut and engage the rack surface 218 of the rack 110.

Figure 21:
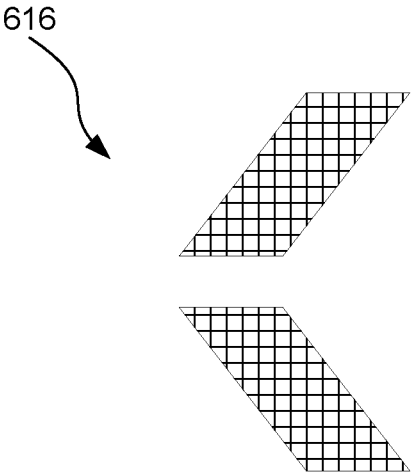
FIG. 21 is a schematic illustration of another tooth profile of the base of a tooth from which a tooth may project for a tooth of the rack or detent of the buckle, with the profile being for a tooth that includes a gap between a pair of teeth in a tooth row.

While the shapes of the various features of the buckle 100 have been described in detail, different shapes may be used. For example, instead of the chevron profile 216 and the chevron profile 516, different profiles may be used. One example of such a different profile 616 is illustrated in FIG. 21, wherein the profile includes a gap between opposite sides of the profile, so that a tooth row can include a pair of teeth separated by a gap. Such a profile may be used for one or both of the rack 110 and the detent 106. Other profiles could also be used, such as profiles with concave or convex curves where sides are straight in the profile 216 and the profile 516. Additionally, the thickness, rounding, beveling, specific angles, and other geometric features of the different parts may be different from what is illustrated herein. Indeed, different geometries may be used for different applications.

Also, while not illustrated herein, a strap may be secured around a strap bar 540 on the top front of the detent 106, so that the strap may be manually grasped and pulled upward to disengage the detent 106 and bring the buckle 100 out of the buckled configuration.

II. BUCKLE MANUFACTURING AND MATERIALS

The parts of the buckle 100 can each be made by various manufacturing techniques using various materials, so long as the materials are sufficiently rigid, strong, and durable to operate as discussed herein without undue flexing, breaking, or wear during repeated operation as discussed below. Auxiliary parts such as the springs, the strap retainer, and the rivets or pivots may be purchased as standard parts, such as standard metal parts. Other parts may all be made of metal, which may be cast and/or machined using subtractive techniques (milling, drilling etc.). Some or all the parts may be formed of polymer materials and/or composite materials, such as fiber reinforced composites. Some or all the parts may be formed using additive techniques, such as three-dimensional printing, e.g., metal three-dimensional printing or three-dimensional printing of polymer materials with fiber reinforcement, which may be done using a dual head extruder. As another example, some or all the parts may be formed by injection molding, such as injection molding of fiber reinforced polymer materials (such as nylon or polypropylene reinforced with fibers such as poly-paraphenylene terephthalamide, carbon, or glass fibers). Of course, in some application some or all the parts may be formed of polymer materials that are not reinforced with fibers, or with other materials.

III. BUCKLE OPERATION

Figure 9:
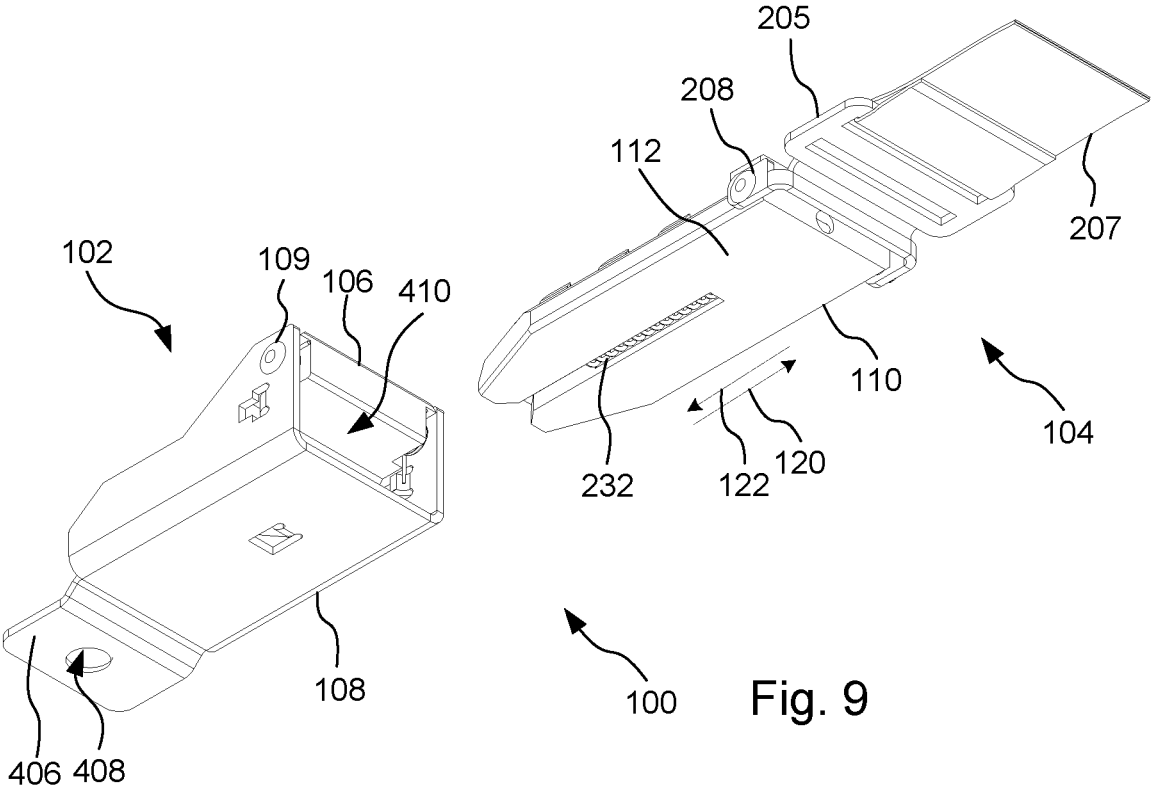
FIG. 9 is a back, side, bottom perspective view of the buckle FIG. 2 in an unbuckled configuration with the male buckle member of FIG. 8 separated from a female buckle member (which may be called a first buckle member or a second buckle member herein), also illustrating an insertion direction and an extraction direction of the male buckle member relative to the female buckle member.
Figure 10:
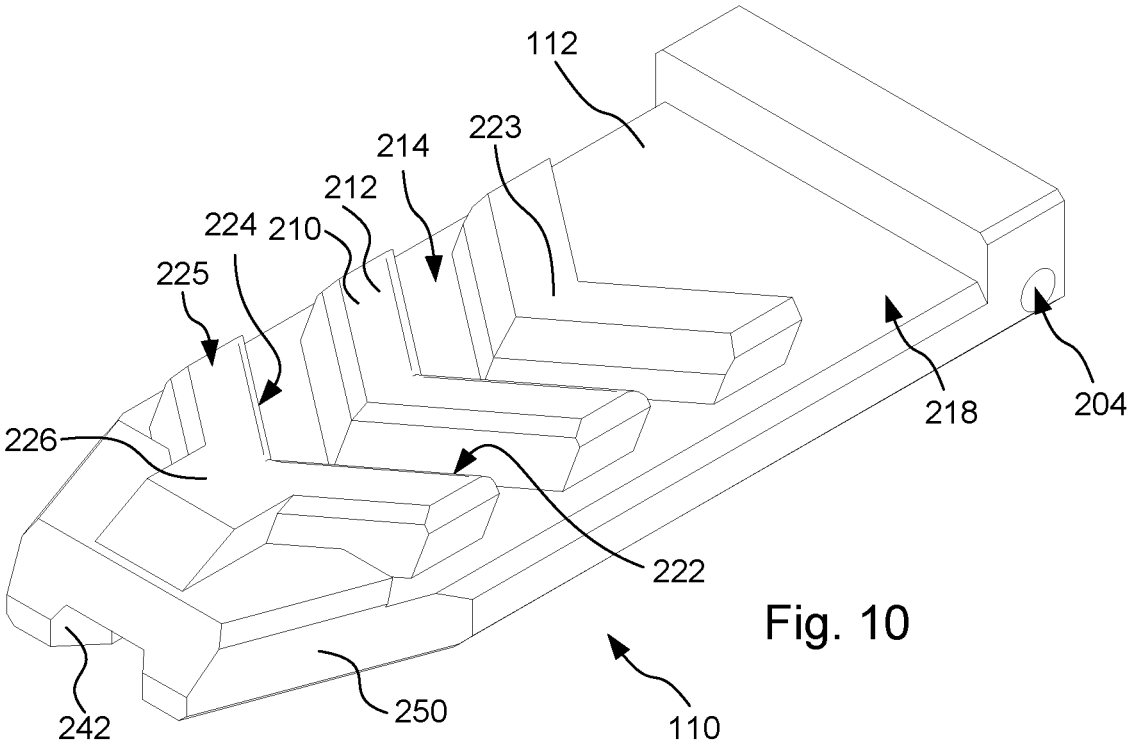
FIG. 10 is a front, side, top perspective view of a rack of the male buckle member of FIG. 8.
Figure 11:
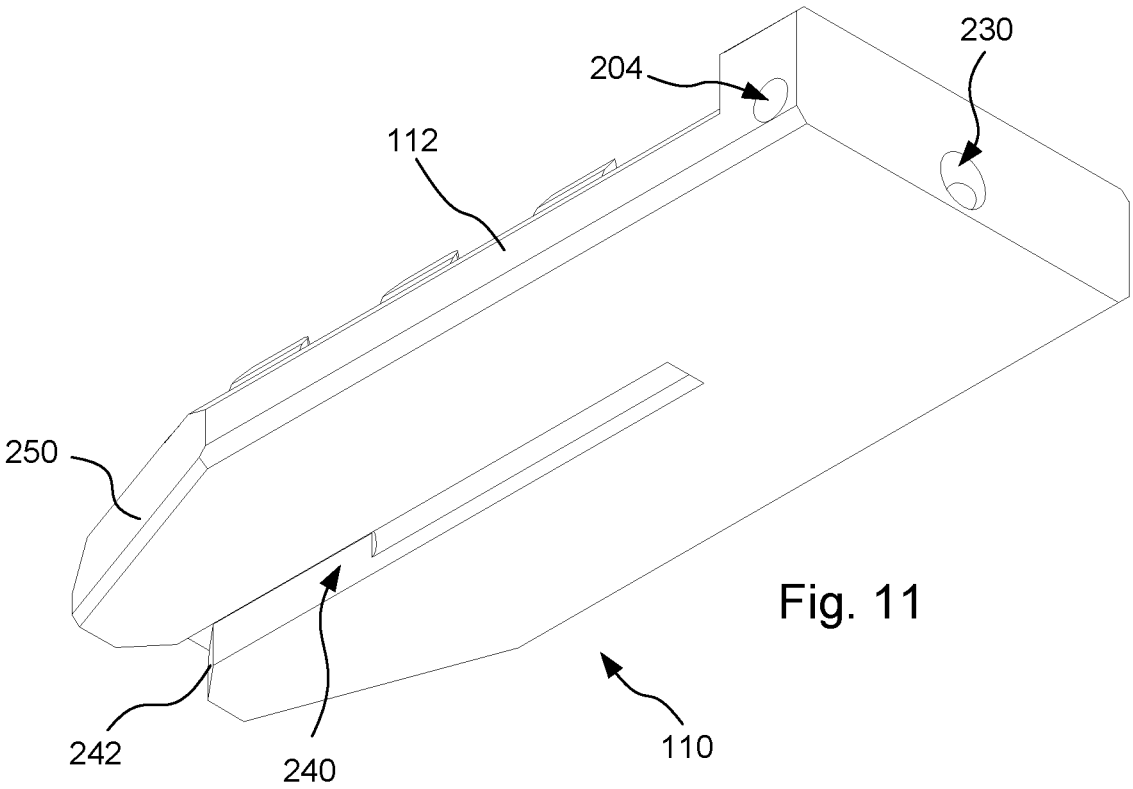
FIG. 11 is a back, side, bottom perspective view of the rack of FIG. 10.
Figure 12:
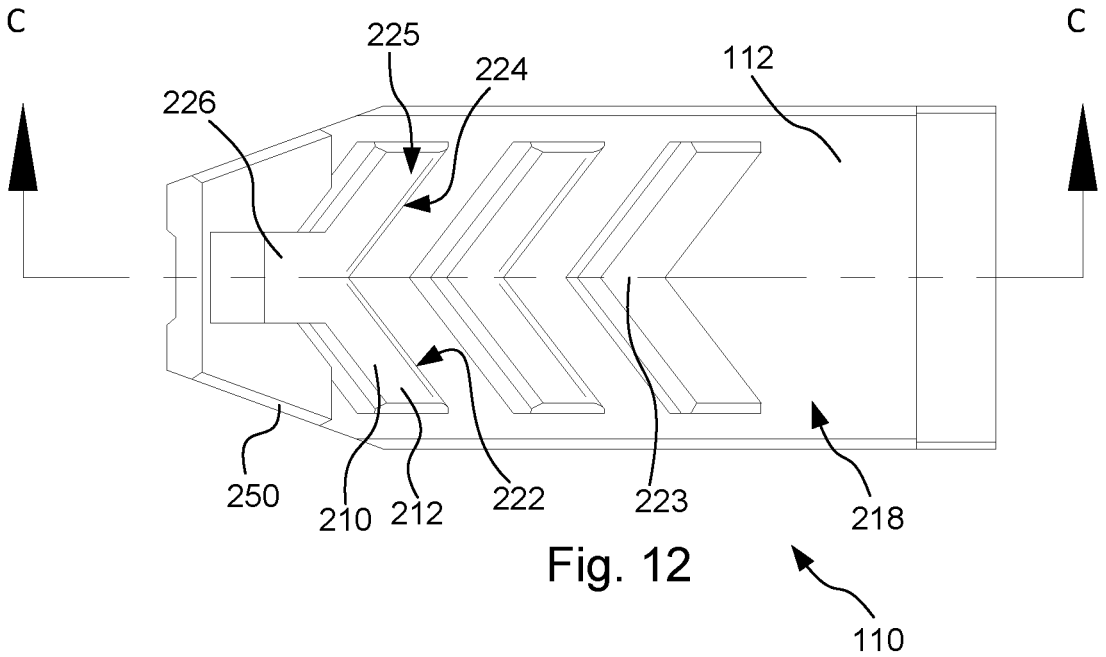
FIG. 12 is a top view of the rack of FIG. 10.
Figure 13:
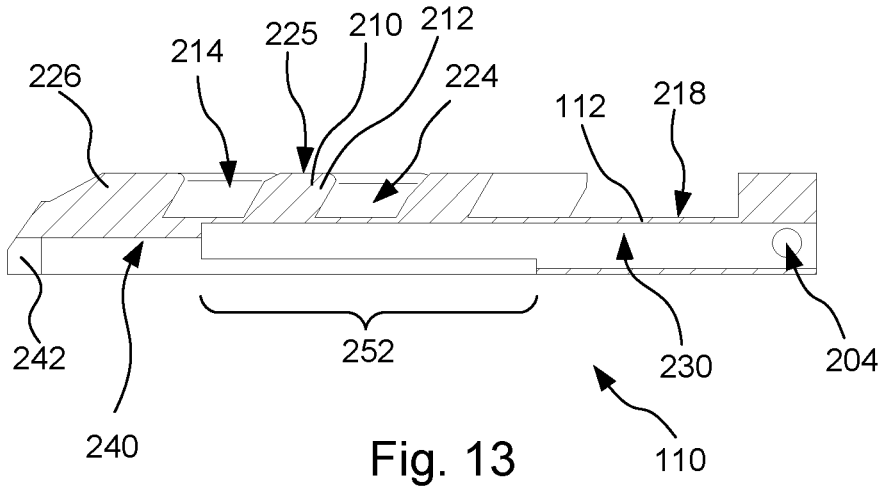
FIG. 13 is a side sectional view of the rack of FIG. 10, taken along line C-C of FIG. 12.

The way the first embodiment is operated can be separated into two parts: engagement and disengagement. FIGS. 2-6 illustrate a fully assembled and engaged buckled configuration of the buckle 100, as discussed above. FIG. 9 illustrates a disengaged unbuckled configuration wherein the male buckle member 104 and the female buckle member 102 are separated from each other.

A. Engaging the Buckle

Engagement of the buckle 100 will now be discussed. Before operation of the buckle 100, the male buckle member 104 can be provided attached to the strap 207 by way of the strap retainer 205. The other end of the strap 207 can be anchored, tacked, or otherwise fixed in place directly on or nearby an object which the buckle 100 is intended to secure. Similarly, female buckle member 102 can be tacked either directly or indirectly to that same object or another object, through the tacking hole 408 of the base 108. The buckle 100 may be modified to be used to secure to different objects, such as securing two ends of ropes, chains, or cables together, securing two straps to each other (by including a strap retainer on the female buckle), or securing other non-strap objects to each other.

Engagement of the embodiment about the object intended to be secured or otherwise securing one or more objects together can be initiated by first grasping the male buckle member 104 in the approximate area between strap retainer and bossed teeth; the male buckle member can be grasped in different ways so long as the engagement pilot 226 and the teeth 212 remain unobstructed. Once grasped, the male buckle member 104 can be linearly inserted in the insertion direction 122 relative to the female buckle member 102 (which may be performed by moving the male buckle member 104 and/or the female buckle member 102) into the entry 410 of the female buckle member 102. The insertion tapers 250 can guide the rack 110 to be centered between the side walls of the base 108. The engagement pilot 226 can displace the detent 106, pushing the detent 106 up as the detent 106 rotates around the pivot 109, overcoming the opposing energy of the torsion springs 305.

As the male buckle member 104 continues to advance in the insertion direction 122 relative to the female buckle member 102, the rack 110 can be guided to self-center over the catch 404 of the base 108 by the catch taper 242 and the access slot 240. After the point at which the catch 404 ingresses into the slot and bore overlap 252, advancement can be against the added resistance of the compression spring 232 bearing against the catch 404 of the base 108 and the rivet 208 of the male buckle member 104, thus storing potential energy for use in ejection of the male buckle member 104 relative to the female buckle member 102 at the time of disengagement.

The rear-most tooth row 510 of the detent 106 can partially ratchet downwards as the engagement pilot 226 of the rack 110 passes beneath it, but will not fully seat because the engagement pilot 226 can obstruct another more forward tooth row 510 of the detent 106 from moving downward into a fully seated position. However, when the engagement pilot 226 and the front-most tooth row 210 of the rack 110 have advanced beyond the front-most tooth row 510 of the detent 106, all the tooth rows 510 of the detent 106 will be able to fully mesh with the tooth rows 210 of the rack 110 as a consequence of torsion springs 305 biasing the detent 106 toward the rack 110. In this buckled configuration, the movement of the detent 106 downward toward the rack 110 can be stopped by engagement between the distal surface portion(s) 224 of the teeth 212 of the rack 110 and the detent surface 518, and/or between the distal surface portion(s) 524 of the teeth 512 of the detent 106 and the rack surface 218.

Due to the drafted profile of the teeth 212 of the rack 110 and the teeth 512 of the detent 106, a force tending to withdraw the male buckle member 104 from the female buckle member 102 will only cause the detent 106 to bear down upon rack with more pressure, thus securing the male buckle member 104 to the female buckle member 102 in the buckled configuration until actions are taken to disengage the buckle 100, as discussed below. The compression spring 232 can be configured (such as with its pitch and size) such that it can be compressed when engagement pilot 226 has ensured the intended amount of teeth are engaged, so that the engagement pilot 226 and the compression spring 232 can form obstructions that cooperate with other parts of the buckle 100 to inhibiting erroneous engagement with too few teeth being engaged in either direction (such as if the teeth interlocked with the male buckle member 104 not being inserted far enough into the female buckle member 102 or being inserted too far into the female buckle member 102).

In the buckled configuration, as a tension force is applied to the buckle 100 in the buckled configuration pulling the male buckle member 104 and the female buckle member 102 away from each other, the engagements between the teeth 212 of the rack 110 and the teeth 512 of the detent 106 (as well as between the teeth 512 of the detent 106 and the rack surface 218 and/or between the teeth 212 of the rack 110 and the detent surface 518) can oppose the tension force and can use the tension force to guide the rack 110 and the detent 106 toward a centered position by drawing the rack 110 toward the detent 106 (the rack is drawn up and the detent 106 is drawn down because of the slope of the engaging surface portions of the teeth along planes that are parallel to the extraction direction 120 and perpendicular to the rack surface 218 and the detent surface 518, and because of the pivot 109 being located above the entry 410). Also, the engagements can use the tension force to guide the rack 110 and the detent 106 laterally from side-to-side toward a centered position wherein the central portion 223 aligns with the central portion 523 by the slope of the engaging surface portions of the teeth along planes that are parallel to the rack surface 218 and the detent surface 518.

B. Disengaging the Buckle

To disengage the buckle 100, the front of the detent 106 can be manually pulled upward relative to the base 108, such as by pulling on a tab (strap, etc. that is not shown) that can be permanently looped around the strap bar 540 of the detent 106. As the detent 106 rotates up and away from the rack, the teeth 512 of the detent 106 can lift up and out of the space between the teeth 212 of the rack 110 to an unbuckled configuration, thus capacitating the release of potential energy stored in an ejection mechanism 700 that includes the compression spring 232. The ejection mechanism 700 (see FIGS. 5-6) can also include other members that interact with the compression spring 232 in ejecting the male buckle member 104 from the female buckle member 102, such as the catch 404 (which can press against on end of the compression spring 232), the rivet 208 (which can press against the other end of the compression spring 232, and can act as a second catch on the male buckle member 104 to oppose the catch 104 on the female buckle member 102), and the material surrounding the spring bore 230 (which can laterally restrain the compression spring 232). In the ejection mechanism, the spring may be a different type of spring from the mechanical solid matter compression spring illustrated. For example, the spring of the ejection mechanism can be a mechanical solid matter extension spring, a contained liquid or gaseous fluid spring (such as a hydraulic spring), or a magnetic spring. For example, with a magnetic spring, one catch can support and engage (possibly be fixed to) a first magnetic element (a magnet or a member that is repelled or attracted by a magnet) and can be mounted on the male buckle member. Another catch can support and engage (possibly be fixed to) a second magnetic element (again, a magnet or a member that is repelled or attracted by the first magnetic element) and can be mounted on the female buckle member. The magnetic elements can together form the magnetic spring. The magnetic spring can use the repulsion or attraction between the magnetic elements to oppose the insertion of the male buckle member into the female buckle member during engaging of the buckle, so that in the buckled configuration, the magnetic spring can be energized, as with the compression spring 232. Indeed, with any of these types of springs, the spring can oppose the insertion of the buckle members as they are engaged in the buckled configuration to energize the spring. The spring can be energized while the buckle is in the buckled configuration. And the spring can release energy to bias the buckle members away from each other and away from the buckled configuration during disengagement. For example, in the illustrated embodiment, the compression spring 232 of the male buckle member 104 can expand against the catch 404 of the female buckle member 102, which can cause the male buckle member 104 to eject away from the female buckle member 102.

After the male buckle member 104 has cleared the entry 410, the user can then release the detent 106, thus allowing torsion springs to urge the detent 106 down to its static state. The buckle can then be re-engaged in accordance with the above operation discussion when desired.

IV. SOME EXAMPLES OF BUCKLE VARIATIONS

There are a variety of changes and additions that can be made to the buckle 100, producing many different possible embodiments. Some changes are briefly discussed here. Some such changes may produce changes in the operation that will be apparent. For example, if a linearly sliding detent is used instead of a rotating detent, such a detent can be slid out of engagement instead of rotated out of engagement during the disengagement operation.

An alternative embodiment may rely on alternative means to act upon the detent such that the buckle disengages. For example, where the embodiment is subjected to relatively high tension, a lever-like protrusion or boss may extend backwards away from rear of the detent. Rather than pulling up on detent as discussed above, a user can press down on the lever, offering the benefit of mechanical advantage in disengaging the buckle while under high strain.

The members through which one embodiment may interface with an existing apparatus are also subject to many possibilities, as has been discussed to some extent above. For example, rather than the female buckle member relying on a tacking tab to interface with tertiary members, the base may incorporate a feature similar to the strap retainer of the male buckle member to facilitate attachment to a flat elastic material such as nylon or polypropylene webbing. Such an embodiment could be implemented as a tough yet convenient solution in many use cases in which safety is a concern, such as performance racing helmets, fall restraint systems, and/or automotive safety restraints.

While the size, mechanical requirements, and methods of interface with peripheral accouterments may vary by use case, the operation of different embodiments can primarily remain unchanged. Referring to the example of automotive safety restraints, a given restraint system has the often mutually exclusive requirements of being tough enough to restrain the driver in a collision, while also allowing the driver to rapidly and easily extricate from the harness restraint in the event that a fire is ignited, as often occurs in high performance racing. In such an event, one would merely need to actuate the detent as exemplified in the operation section to be free of all elements of the safety restraint system. This could increase the survivability of collisions or catastrophic failures.

Changes to the two-dimensional tooth profile and the three-dimensional projection of the teeth in different embodiments could be as equally advantageous as there are many. For example, rather than being a single closed profile as illustrated in the buckle 100, the profile could include two shapes that are generally mirrored and symmetrical parallelograms, illustrated in FIG. 21. In the example of CNC machining, the clearance between the convergence of the two parallelograms could prove valuable for evacuation of removed material. Thus, the profile can be changed to assist with manufacturability and/or use of the buckle.

V. ASPECTS OF BUCKLES

Some aspects of buckles according to the description herein will now be discussed.

According to a first aspect, a buckle can include a first buckle member, which may include a body and a row of one or more teeth extending from the body. The buckle can also include a second buckle member, which may include a body and a row of one or more teeth extending from the body, with the first buckle member and the second buckle member being configured to be secured to each other in a buckled configuration and to be separated from each other in an unbuckled configuration by moving the first buckle member relative to the second buckle member along an extraction direction. The first buckle member and the second buckle member can be configured so that in the buckled configuration the row of one or more teeth of the first buckle member and the row of one or more teeth of the second buckle member cooperate in responding to a tension force pulling the first buckle member away from the second buckle member along the extraction direction. This response may include opposing movement of the first buckle member away from the second buckle member along the extraction direction and using the tension force to guide the first buckle member and the second buckle member laterally toward a centered position relative to each other. The guiding toward the centered position may include guiding a central portion of the row of one or more teeth of the first buckle member along a first lateral direction to align with a central portion of the row of one or more teeth of the second buckle member, and guiding the first buckle member along a second lateral direction to bias the row of one or more teeth of the first buckle member toward a base of the row of one or more teeth of the second buckle member.

Implementations of this aspect may include one or more of the following features. The using of the tension force to guide the first buckle member and the second buckle member laterally toward the centered position may include guiding the row of one or more teeth of the second buckle member along the row of one or more teeth of the first buckle member to press the row of one or more teeth of the second buckle member against a body surface of the body of the first buckle member that is adjacent to the row of one or more teeth of the first buckle member. At least one of the first buckle member and the second buckle member can be configured to be secured to a strap that is configured so that a pulling force applied along the strap produces the tension force pulling the first buckle member away from the second buckle member in the extraction direction.

The first buckle member may include a first set of multiple rows of teeth, and the second buckle member may include a second set of multiple rows of teeth that are configured to interlock with the first set of multiple rows of teeth to participate in removably securing the second buckle member to the first buckle member in the buckled configuration. The second buckle member further may include an obstruction that is configured to inhibit engagement between the first set of multiple rows of teeth and the second set of multiple rows of teeth until a predetermined number of rows of the first set of multiple rows of teeth are aligned to interlock with a predetermined number of rows of the second set of multiple rows of teeth, where the predetermined number of rows of the first set of multiple rows of teeth is at least two and the predetermined number of rows of the second set of multiple rows of teeth is at least two.

The buckle may include a buckle ejection mechanism, which may include the following: a catch that is part of one of the first buckle member and the second buckle member; and a spring that is part of the other of the first buckle member and the second buckle member, with the first buckle member and the second buckle member being configured so that the catch engages and energizes the spring as the first buckle member is moved relative to the second buckle member into the buckled configuration, and with the first buckle member and the second buckle member being configured so that the spring uses the catch to bias the first buckle member and the second buckle member away from each other and out of the buckled configuration when the first buckle member is not secured to the second buckle member.

The first engaging surface portion and the second engaging surface portion may be angled at non-perpendicular and non-parallel angles relative to the extraction direction along a second plane extending parallel to the extraction direction and perpendicular to the first plane.

According to a second aspect, a buckle can include a first buckle member, which may include a first set of multiple rows of teeth. The buckle can also include a second buckle member, which may include a second set of multiple rows of teeth that are configured to interlock with the first set of multiple rows of teeth to removably secure the second buckle member to the first buckle member in a buckled configuration. The second buckle member may also include an obstruction that is configured to inhibit engagement between the first set of multiple rows of teeth and the second set of multiple rows of teeth until a predetermined number of rows of the first set of multiple rows of teeth are aligned to interlock with a predetermined number of rows of the second set of multiple rows of teeth, where the predetermined number of rows of the first set of multiple rows of teeth is at least two and the predetermined number of rows of the second set of multiple rows of teeth is at least two.

Implementations may include one or more of the following features. The obstruction can be a pilot boss that is configured to aid in guiding the first buckle member and the second buckle member into a buckled configuration with each other, where the second buckle member can be removably secured to the first buckle member in the buckled configuration. The obstruction can be a pilot boss that is configured to push the first set of multiple rows of teeth away from blocking movement of the second buckle member toward the first buckle member as the first buckle member and the second buckle member are moved into a buckled configuration with each other, where the second buckle member is removably secured to the first buckle member in the buckled configuration. The obstruction can be configured to be positioned ahead of the second set of multiple rows of teeth as the second buckle member moves into a buckled configuration with the first buckle member, where the second buckle member is removably secured to the first buckle member in the buckled configuration.

The buckle may include a buckle ejection mechanism, which may include the following: a catch that is part of one of the first buckle member and the second buckle member; and a spring that is part of the other of the first buckle member and the second buckle member, with the first buckle member and the second buckle member being configured so that the catch engages and energizes the spring as the first buckle member is moved relative to the second buckle member into the buckled configuration, and with the first buckle member and the second buckle member being configured so that the spring uses the catch to bias the first buckle member and the second buckle member away from each other and out of the buckled configuration when the first buckle member is not secured to the second buckle member.

The first set of multiple rows of teeth may include a row of one or more teeth of the first buckle member; and the second set of multiple rows of teeth may include a row of one or more teeth of the second buckle member. The first buckle member and the second buckle member can be configured to be separated from each other in an unbuckled configuration by moving the first buckle member relative to the second buckle member along an extraction direction, with the first buckle member and the second buckle member being configured so that in the buckled configuration the row of one or more teeth of the first buckle member and the row of one or more teeth of the second buckle member cooperate in responding to a tension force pulling the first buckle member away from the second buckle member along the extraction direction by: opposing movement of the first buckle member away from the second buckle member along the extraction direction; and using the tension force to guide the first buckle member and the second buckle member laterally toward a centered position relative to each other. The guiding toward the centered position may include guiding a central portion of the row of one or more teeth of the first buckle member along a first lateral direction to align with a central portion of the row of one or more teeth of the second buckle member, and guiding the first buckle member along a second lateral direction to bias the row of one or more teeth of the first buckle member toward a base of the row of one or more teeth of the second buckle member.

According to a third aspect, a buckle can include a first buckle member. The buckle can also include a second buckle member, with the first buckle member and the second buckle member being configured to be releasably secured to each other in a buckled configuration. The buckle can also include a buckle ejection mechanism, which may include the following: a catch that is part of one of the first buckle member and the second buckle member; and a spring that is part of the other of the first buckle member and the second buckle member. The first buckle member and the second buckle member can be configured so that the catch engages and energizes the spring as the first buckle member is moved relative to the second buckle member into the buckled configuration. Also, the first buckle member and the second buckle member can be configured so that the spring uses the catch to bias the first buckle member and the second buckle member away from each other and out of the buckled configuration when the first buckle member is not secured to the second buckle member.

Implementations may include one or more of the following features. The catch can be a protrusion on the first buckle member, and the protrusion can be configured to extend into a slot in the second buckle member to engage the spring. The energizing of the spring may include compressing the spring.

The first buckle member may include a first set of multiple rows of teeth, and the second buckle member may include a second set of multiple rows of teeth that are configured to interlock with the first set of multiple rows of teeth to removably secure the second buckle member to the first buckle member. The second buckle member further may include an obstruction that is configured to inhibit engagement between the first set of multiple rows of teeth and the second set of multiple rows of teeth until a predetermined number of rows of the first set of multiple rows of teeth are aligned to interlock with a predetermined number of rows of the second set of multiple rows of teeth, where the predetermined number of rows of the first set of multiple rows of teeth is at least two and the predetermined number of rows of the second set of multiple rows of teeth is at least two.

The first buckle member may include a body and a row of one or more teeth extending from the body; the second buckle member may include a body and a row of one or more teeth extending from the body, with the first buckle member and the second buckle member being configured to be secured to each other in a buckled configuration and to be separated from each other in an unbuckled configuration by moving the first buckle member relative to the second buckle member along an extraction direction. The first buckle member and the second buckle member can be configured so that in the buckled configuration the row of one or more teeth of the first buckle member and the row of one or more teeth of the second buckle member cooperate in responding to a tension force pulling the first buckle member away from the second buckle member along the extraction direction by opposing movement of the first buckle member away from the second buckle member along the extraction direction, and using the tension force to guide the first buckle member and the second buckle member laterally toward a centered position relative to each other. The guiding toward the centered position may include guiding a central portion of the row of one or more teeth of the first buckle member along a first lateral direction to align with a central portion of the row of one or more teeth of the second buckle member, and guiding the first buckle member along a second lateral direction to bias the row of one or more teeth of the first buckle member toward a base of the row of one or more teeth of the second buckle member.

According to a fourth aspect, a method of securing a buckle can include securing a first buckle member and a second buckle member together in a buckled configuration. The securing may include a row of one or more teeth of the first buckle member and a row of one or more teeth of the second buckle member cooperating in responding to a tension force pulling the first buckle member away from the second buckle member along an extraction direction by opposing movement of the first buckle member away from the second buckle member along the extraction direction, and using the tension force to guide the first buckle member and the second buckle member laterally toward a centered position relative to each other. The guiding toward the centered position may include the following: guiding a central portion of the row of one or more teeth of the first buckle member along a first lateral direction to align with a central portion of the row of one or more teeth of the second buckle member; and guiding the first buckle member along a second lateral direction to bias the row of one or more teeth of the first buckle member toward a base of the row of one or more teeth of the second buckle member. The securing can also include separating the first buckle member and the second buckle member from each other in an unbuckled configuration. The separating can include disengaging the row of one or more teeth of the first buckle member from the row of one or more teeth of the second buckle member and moving the first buckle member relative to the second buckle member along the extraction direction.

Implementations may include one or more of the following features. The row of one or more teeth of the first buckle member may include a first engaging surface portion and a second engaging surface portion that are each angled at a non-perpendicular and non-parallel angle relative to the extraction direction along a first plane that extends parallel to the extraction direction. The first engaging surface portion and the second engaging surface portion can be angled at non-perpendicular and non-parallel angles relative to the extraction direction along a second plane extending parallel to the extraction direction and perpendicular to the first plane. The using of the tension force to guide the first buckle member and the second buckle member laterally toward the centered position may include guiding the row of one or more teeth of the second buckle member along the row of one or more teeth of the first buckle member to press the row of one or more teeth of the second buckle member against a body surface of a body of the first buckle member that is adjacent to the row of one or more teeth of the first buckle member.

At least one of the first buckle member and the second buckle member can be configured to be secured to a strap that is configured so that a pulling force applied along the strap produces the tension force pulling the first buckle member away from the second buckle member in the extraction direction. The first buckle member may include a first set of multiple rows of teeth, and the second buckle member may include a second set of multiple rows of teeth that interlock with the first set of multiple rows of teeth to participate in releasably securing the second buckle member to the first buckle member in the buckled configuration. The securing of the first buckle member to the second buckle member may include an obstruction of the second buckle member inhibiting engagement between the first set of multiple rows of teeth and the second set of multiple rows of teeth until a predetermined number of rows of the first set of multiple rows of teeth are aligned to interlock with a predetermined number of rows of the second set of multiple rows of teeth, where the predetermined number of rows of the first set of multiple rows of teeth is at least two and the predetermined number of rows of the second set of multiple rows of teeth is at least two.

The securing of the first buckle member and the second buckle member together may include a catch that is part of one of the first buckle member and the second buckle member engaging and energizing a spring that is part of the other of the first buckle member and the second buckle member as the first buckle member is moved relative to the second buckle member into the buckled configuration. Also, the separating of the first buckle member and the second buckle member from each other may include the spring using the catch to bias the first buckle member and the second buckle member away from each other and out of the buckled configuration.

VI. CONCLUSION

As can be seen from the above description, at least one of the embodiments discussed herein can be an advantageous solution to many circumstances that involve the fastening of members such as straps together. There are many use cases in which the mechanical robustness inherent in the described buckle features and their use may be provided without a compromise in ease of use, facilitating accessibility, safety, and versatility. Due to its spring-loaded design, disengagement of various embodiments may be performed with a single hand to quickly release the buckle, which could clear the user from all members, eliminating the potential of them becoming obstructions in many use cases. Another added benefit of a spring-loaded embodiment, as accomplished by a compression spring in the first embodiment, is that it may be able to reduce linear backlash, which can reduce impact forces of mating members as a consequence of sudden tension across the elastic material connected to an embodiment (e.g. forces seen on a racing harness in the event of a collision). Additionally, the tooth profile of multiple embodiments lends to them many benefits that further preclude the shortcomings of existing buckles:

The directional geometry of some embodiments of tooth profiles can ensure that engagement of members is self-centering, precise, and reliable. This characteristic can be further achieved with the addition of other centering geometries, such as a centering taper catch.

The angled protrusion or projection of some embodiment's tooth profiles can provide a ratcheting toothed buckle that can be mechanically superior to other buckles in terms of resistance to shear forces.

The angled protrusion or projection of some embodiment's tooth profiles can also serve to elastically direct forces to the central origin of whatever members that bossed teeth may originate from; an area that maximizes the amount of available material for dissipation of forces. For example, the forces may be directed toward the central portion of the base of each tooth row on the rack and/or on the detent.

Also, a different embodiment of a detent could be arranged to slide in a linear direction into and out of engagement with the rack instead of pivoting as the detent 106 does. As another example, the compression spring could be seated in the female buckle member (such as in the base) to be engaged by a catch that is part of the male buckle member, rather than the compression spring being seated in the male buckle member and being engaged by a catch that is part of the female buckle member as discussed above.

Operationally, some embodiments may have several ramifications that further distinguish them from prior buckles. An engagement pilot may be used to further ensure consistent and predictable operation of the end user by requiring a specifiable quantity of teeth for engagement, while still retaining the functionality of adjustability. A pull tab, lever, or other similar feature for the actuation of a pawl member can facilitate the numerous use cases in which one-handed operation is essential or desirable, e.g. tactical vests and the like, scuba gear, racing restraints and harnesses, fall restraints, and many different types of helmets.

While the description above includes many specifics, it is by no means intended to be a comprehensive representation or limitation of scope, but rather as an exemplification of some potential embodiments. As previously stated, there exists a large variety of use cases and as such, many potential embodiments and variations exist. For example, there may be an embodiment in which the teeth are not integrated (or formed integrally) with the member they originate from (manufactured separately), introducing the possibilities of more accommodating manufacturing methods and broader choice in materials. Additionally, there may exist embodiments that incorporate rotational elements such as gears with the previously mentioned tooth profile, to provide a continuous means of feeding elastic material. Again—the former is intended to be but a few examples.

Accordingly, the scope should not be determined by the embodiments herein illustrated, but by the appended claims and their legal equivalents.

Additionally, the subject matter defined in the appended claims is not necessarily limited to the benefits described herein. An implementation of the invention may provide all, some, or none of the benefits described herein. Although operations for the various techniques are described herein in a particular, sequential order for the sake of presentation, this manner of description encompasses rearrangements in the order of operations, unless a particular ordering is required. For example, operations described sequentially may in some cases be rearranged or performed concurrently.

As the above discussion makes clear, while embodiments are discussed above, it will be understood by those skilled in the art that various changes in form and details may be made therein without departing from the spirit and scope of the invention.

I claim:

1. A buckle comprising:

a first buckle member comprising a body and a row of one or more teeth extending from the body of the first buckle member; and a second buckle member comprising a body and a row of one or more teeth extending from the body of the second buckle member, with the first buckle member and the second buckle member being configured to be secured to each other in a buckled configuration and to be separated from each other in an unbuckled configuration by moving the first buckle member relative to the second buckle member along an extraction direction, with the first buckle member and the second buckle member being configured so that in the buckled configuration the row of one or more teeth of the first buckle member and the row of one or more teeth of the second buckle member cooperate in responding to a tension force pulling the first buckle member away from the second buckle member along the extraction direction by:

opposing movement of the first buckle member away from the second buckle member along the extraction direction; and using the tension force to guide the first buckle member and the second buckle member laterally toward a centered position relative to each other, with the guiding toward the centered position comprising guiding a central portion of the row of one or more teeth of the first buckle member along a first lateral direction to align with a central portion of the row of one or more teeth of the second buckle member, and guiding the first buckle member along a second lateral direction to bias the row of one or more teeth of the first buckle member toward a base of the row of one or more teeth of the second buckle member.

2. The buckle of claim 1, wherein the row of one or more teeth of the first buckle member comprises a first engaging surface portion and a second engaging surface portion that are each angled at a non-perpendicular and non-parallel angle relative to the extraction direction along a first plane that extends parallel to the extraction direction.

3. The buckle of claim 2, wherein the first engaging surface portion and the second engaging surface portion are angled at non-perpendicular and non-parallel angles relative to the extraction direction along a second plane extending parallel to the extraction direction and perpendicular to the first plane.

4. The buckle of claim 1, wherein the using of the tension force to guide the first buckle member and the second buckle member laterally toward the centered position comprises guiding the row of one or more teeth of the second buckle member along the row of one or more teeth of the first buckle member to press the row of one or more teeth of the second buckle member against a body surface of the body of the first buckle member that is adjacent to the row of one or more teeth of the first buckle member.

5. The buckle of claim 1, wherein at least one of the first buckle member and the second buckle member is configured to be secured to a strap that is configured so that a pulling force applied along the strap produces the tension force pulling the first buckle member away from the second buckle member in the extraction direction.

6. The buckle of claim 1, wherein:

the first buckle member comprises a first set of multiple rows of teeth; and the second buckle member comprises a second set of multiple rows of teeth that are configured to interlock with the first set of multiple rows of teeth to participate in removably securing the second buckle member to the first buckle member in the buckled configuration.

7. The buckle of claim 6, wherein the second buckle member further comprises an obstruction that is configured to inhibit engagement between the first set of multiple rows of teeth and the second set of multiple rows of teeth until a predetermined number of rows of the first set of multiple rows of teeth are aligned to interlock with a predetermined number of rows of the second set of multiple rows of teeth, wherein the predetermined number of rows of the first set of multiple rows of teeth is at least two and the predetermined number of rows of the second set of multiple rows of teeth is at least two.

8. The buckle of claim 1, further comprising:

a buckle ejection mechanism comprising:

a catch; and a spring, with the first buckle member and the second buckle member being configured so that the catch engages and energizes the spring as the first buckle member is moved relative to the second buckle member into the buckled configuration, and with the first buckle member and the second buckle member being configured so that the spring uses the catch to bias the first buckle member and the second buckle member away from each other and out of the buckled configuration when the first buckle member is not secured to the second buckle member.

9. The buckle of claim 1, wherein the first buckle member and the second buckle member are configured so that in the buckled configuration the row of one or more teeth of the first buckle member and the row of one or more teeth of the second buckle member cooperate in responding to the tension force pulling the first buckle member away from the second buckle member along the extraction direction by causing the first buckle member to bear down upon the second buckle member with more pressure in response to the tension force to keep the first buckle member and the second buckle member secured to each other in the buckled configuration.

* * * * *